US008371571B2

(12) United States Patent
Silberbauer et al.

(10) Patent No.: US 8,371,571 B2
(45) Date of Patent: Feb. 12, 2013

(54) METHOD AND DEVICE FOR INSERTING SUPPLEMENTS INTO MULTIPAGE PRINTED PRODUCTS

(75) Inventors: Guenther Silberbauer, Uerkheim (CH); Konrad Boos, Stettfurt (CH)

(73) Assignee: Mueller Martini Holdings AG, Hergiswil (CH)

( * ) Notice: Subject to any disclaimer, the term of this patent is extended or adjusted under 35 U.S.C. 154(b) by 0 days.

(21) Appl. No.: 13/195,322

(22) Filed: Aug. 1, 2011

(65) Prior Publication Data

US 2012/0068397 A1 Mar. 22, 2012

(30) Foreign Application Priority Data

Jul. 30, 2010 (CH) ..... 1260/10

(51) Int. Cl.
*B42C 1/10* (2006.01)

(52) U.S. Cl. ..... 270/52.23; 270/52.24; 270/52.28; 270/52.03

(58) Field of Classification Search ..... 270/52.23, 270/52.24, 52.25, 52.27, 52.28, 52.22, 52.03, 270/52.17
See application file for complete search history.

(56) References Cited

U.S. PATENT DOCUMENTS

| | | | | |
|---|---|---|---|---|
| 2,873,113 | A | 2/1959 | McWhorter | |
| 3,692,301 | A * | 9/1972 | Wetter | 270/52.23 |
| 3,722,877 | A | 3/1973 | Wetter | |
| 3,951,399 | A | 4/1976 | Reist | |
| 4,420,146 | A * | 12/1983 | Reist | 270/52.23 |
| 4,486,011 | A | 12/1984 | Rhunke | |
| 4,989,850 | A * | 2/1991 | Weller | 270/1.02 |
| 5,112,036 | A * | 5/1992 | Hatt | 270/52.23 |
| 5,441,245 | A * | 8/1995 | Fluckiger | 270/52.23 |
| 5,443,250 | A * | 8/1995 | Gosslinghoff | 270/52.23 |
| 6,017,027 | A * | 1/2000 | Jaeger | 270/52.23 |
| 6,095,511 | A * | 8/2000 | Jager | 270/52.29 |
| 6,257,566 | B1 * | 7/2001 | Dooley | 270/52.18 |
| 6,283,466 | B1 * | 9/2001 | Jaeger | 270/52.23 |
| 6,375,179 | B1 * | 4/2002 | Boss et al. | 270/52.27 |
| 6,691,996 | B2 * | 2/2004 | Kaya et al. | 270/52.25 |
| 6,916,018 | B2 * | 7/2005 | Graushar et al. | 270/4 |

FOREIGN PATENT DOCUMENTS

| | | |
|---|---|---|
| EP | 0 577 964 A1 | 5/1993 |
| EP | 1 559 573 A1 | 2/2004 |

OTHER PUBLICATIONS

International Search Report, dated Jan. 31, 2011, issued in connection with counterpart Switzerland Application No. CH 12602010 (No. Assigned by International Search Office—SN 54740).
Expanded European Search Report issued in EP 11174616.0 dated Jan. 31, 2012.

* cited by examiner

*Primary Examiner* — Patrick Mackey
(74) *Attorney, Agent, or Firm* — Venable LLP; Robert Kinberg

(57) ABSTRACT

A method for inserting a supplement into a multipage printed product having a back and composed of signatures and/or individual sheets, and being transported with the back oriented parallel to a conveying direction. The multipage printed product is supplied with a signature or an individual sheet projecting from the multipage printed product to define a predetermined separating location between the projecting signature or individual sheet and an adjacent signature or sheet. The multipage printed product is opened at the predetermined separating location and then the opening is expanded. The supplement is thereafter inserted into the expanded separating location.

27 Claims, 9 Drawing Sheets

METHOD AND DEVICE FOR INSERTING SUPPLEMENTS INTO MULTIPAGE PRINTED PRODUCTS

CROSS-REFERENCE TO RELATED APPLICATION

This application claims the priority of Swiss Patent Application No. 01260/10, filed on Jul. 30, 2010, the subject matter of which is incorporated herein by reference in its entirety.

BACKGROUND OF THE INVENTION

The invention relates to a method for inserting at least one supplement into multipage printed products, respectively provided with a back and composed of signatures and/or individual sheets, and which are transported with the backs oriented parallel to a conveying direction. The invention also relates to an insertion device for inserting at least one supplement into multipage printed products composed of signatures and/or individual sheets, with a back oriented parallel to the conveying direction of the insertion device.

To increase the use value of printed products that are bound along the back, such as books, pamphlets, catalogs, magazines or similar products, it is standard practice to add loose supplements to these printed products. Supplements in this case are understood to be flat items, for example CDs/DVDs, individual sheets, signatures, thin booklets, response cards, flat bags or goods samples which are inserted loosely between two adjacent pages of the printed product.

European patent document EP 0577964 A1 discloses a method and a device for inserting supplements between the pages of printed products, wherein a gas flow is used to separate the pages. The dynamic pressure generated upon impact with the front surface is intended to fan out and separate the pages. Following this, a supplement can be inserted between the pages separated by the flow of air. However, a separation at a precise, predetermined page of the printed product is not possible with this method and thus the insertion cannot be made between precisely specified pages.

European patent document EP 1559573 A1 discloses a method for placing the supplements onto specified printed products, which are conveyed while positioned horizontally and are subsequently stacked to form a loose book block. The supplements can thus be supplied in a reproducible manner to precisely specified pages, but it may also result in an undesirable binding of the supplements along with the printed products during the subsequent binding operation. To prevent this, the supplements must be positioned and secured on the surface of the printed product so that they come to rest outside of the binding region for the product.

According to a different, known method for producing printed products, signatures and/or printed individual sheets are initially gathered in a gathering machine to form loose book blocks and these are subsequently bound along the back with the aid of adhesive binding, wire or thread stitching. The printed product is normally provided with a cover which is then connected to the book block. The book blocks, bound crudely in this manner, are then trimmed on the open side along the top and bottom. For the insertion of the supplements, the book blocks must be opened before or after the trimming or cutting operation. It is furthermore known to lift up the cover of the book block with the aid of suction elements or to open up the book block with a sword and to insert one or several supplements into the book block opened in this way. The disadvantage of this method is that the book block cannot be opened precisely to the desired page, meaning between two optionally specified pages, so that the supplements cannot be inserted between the precisely specified pages of the book block.

According to a different known method, one or more supplements are supplied to loose, non-bound book blocks following the gathering operation and prior to the binding operation, wherein the book blocks are again opened with the aid of a sword before the supplements are supplied. With this method it is also not possible to open the book blocks at the precisely specified pages and to purposely place the supplements between optionally pre-defined pages. The supplement must furthermore be positioned and secured on the surface of the book block so that it comes to rest outside of the binding region. Otherwise, there is danger that the supplement will be fixedly bound along with the book block.

SUMMARY OF THE INVENTION

It is an object of the invention to provide a method which, following the gathering or collating, allows opening multipage printed products at one or more predetermined page locations and to place supplements precisely between two specified pages.

The above and other objects are achieved according an embodiment of the invention by the provision of a method for inserting a supplement into a multipage printed product, having a back and composed of signatures and/or individual sheets, and being transported with the back oriented parallel to a conveying direction, comprising: supplying the multipage printed product with a signature or an individual sheet projecting from the multipage printed product to define a predetermined separating location between the projecting signature or individual sheet and an adjacent signature or sheet; opening the multipage printed product at the predetermined separating location; expanding the opening at the separating location in the multipage printed product; and inserting the supplement into the expanded separating location.

Thus, in the method in the above embodiment the multipage printed document is supplied with a signature and/or an individual sheet that projects from the multipage printed product to define a predetermined separating location between two adjacent signatures, or two individual sheets, or between a signature and an individual sheet. The multipage printed product is opened at the separating location and the opening at the separating location is then expanded. Finally, a supplement is placed into the expanded separating location. The opening and expanding of the multipage printed product at the separating location offers the advantage that a preseparation is possible at the precisely specified page for placing the supplement. As a result, damage to the printed product caused by an uncontrolled entering of a separating element into its closed page region is avoided.

According to a further embodiment, there is provided a format-preparing step in which at least two signatures, or two individual sheets, or a signature and an individual sheet with respective formats are produced, wherein one signature or one individual sheet has a format that differs from the format of the other signature or individual sheet. The signatures and/or the individual sheets are gathered into the multipage printed product, wherein by arranging the two signatures or the two individual sheets, or the signature and sheet having different formats immediately adjacent to each other, at least one separating location is formed where one signature or one individual sheet projects from the multipage printed product.

According to an embodiment, the format-preparing step for the above-described method takes place at a separate time and/or space, or immediately prior to supplying the multipage printed products.

To form the separating location according to the present method, the at least one signature and/or the at least one individual sheet may be produced during the format-preparing step with a different back length and/or a different width from that of the other signatures and/or individual sheets. One favorable precondition for the further processing results from the fact that the multipage printed products are aligned in the conveying direction relative to two reference edges and are transported with the backs pointing downward while pushed along in the conveying direction with the aid of pushers.

The multipage printed products may be book blocks, composed of signatures and/or individual sheets which are loosely gathered or crudely bound with the aid of adhesive, wire-stitching or thread-stitching. According to one embodiment, the printed products comprising a signature and/or an individual sheet with a back length that differs from the back length of the other signatures and/or individual sheets are opened along a front edge with the aid of opening elements inserted from the side into the separating location. A more precise separation can be achieved if the opening elements are inserted into the separating location of the multipage printed products at an acute angle relative to a line extending perpendicular to the conveying direction.

According to another embodiment, the movement sequence for the opening elements follows a control curve extending in the conveying direction. This permits precisely specifying when, where and how the opening elements must enter the multipage printed product. The opening elements may be driven with a first speed and the pushers driven with a second speed, wherein the two speeds are at least approximately the same in the conveying direction. As a result, the desired pre-separation can be carried out without requiring a relative speed in the conveying direction and without bending or damaging the multipage printed products. In a further embodiment, the speed of the pushers and the speed of the opening elements may be changed cyclically and synchronously, so that it is possible to react with corresponding flexibility to deviations or interferences. As a result, an even greater coordination is possible between the parallel moving conveying mechanism and the opening devices.

According to a different embodiment, opening elements are arranged on both sides in the conveying direction, thus making it possible for the opening elements to open the multipage printed products from both sides. A plurality of supplements can thus also be inserted simultaneously into precisely specified, side-by-side arranged openings in the multipage printed product.

According to a another embodiment, the printed products, which are provided with a signature and/or an individual sheet having a width that differs from that of the other signatures and/or individual sheets, are opened along one upper edge by inserting an opening element that is embodied as an opening blade. The distance between the opening element and the back of the multipage printed products may be adjusted according to their width. The separating location is expanded with a separating sword and the at least one supplement may be inserted into the multipage printed product through a feed opening in the separating sword. The position in height of the opening elements, relative to a plane extending parallel through the back the printed product, may be adjusted to correspond to the width of the multipage printed products. Owing to the fact that the height position of the opening elements relative to a support and parallel to this support can be adjusted corresponding to the printed products to be processed, the device for inserting the at least one supplement into the multipage printed products may be adapted to different types of printed products.

In another embodiment the supplements may be supplied to the multipage printed product with a speed component of a feeding speed which corresponds at least approximately to the conveying speed of the multipage printed products in the conveying direction. The appearance of a relative speed in the conveying direction is thus advantageously avoided at the instant when the supplements slide into the opened multipage printed products, which could otherwise result in the supplements dropping out, or being displaced or damaged.

According to yet another embodiment, a plurality of separating locations are provided in a multipage printed product, wherein the printed product is opened at these separating locations and at least one supplement is respectively placed inside.

According to one embodiment, the supplements are inserted into the opened multipage printed product at an angle between 0 degrees and 180 degrees, preferably approximately perpendicular, to a plane extending through the back. As a result of the gravitational pull on the printed product, higher speeds are possible when inserting the supplements in the perpendicular direction. However, if other structural conditions should make this type of insertion more difficult, the supplements can also be inserted at an optional angle between 0 degrees and 180 degrees into the opened printed product. The backs of the printed products could be aligned transverse to the conveying direction for this, at an optional angle between 0 degrees and 360 degrees.

During the transport in the region where supplements are inserted, the multipage printed products may be compressed on the side in a region of the back, so as to prevent a fanning out in this region as well as to avoid damage to the printed products.

According to a further embodiment, there is provided an insertion device to insert a supplement into a multipage printed product composed of signatures and/or individual sheets with a back oriented parallel to a conveying direction of the insertion device, comprising: a conveying mechanism to convey the multipage printed product in the conveying direction; an opening device to open the multipage printed product at a predetermined separating location where a signature or an individual sheet projects from the multipage printed product; and a feeding arrangement to insert the supplement at the separating location, wherein the opening device comprises an opening element which is adapted to be inserted at the separating location.

The insertion device for one embodiment has a format-preparing region, with at least one stacking device for forming the separating location in the multipage printed products.

The insertion device can be provided with a control unit for activating printing presses and/or a cutting device, as well as the stacking device. The control unit subsequently takes over the activation of the devices connected via the control connections, for example to generate markings on the printed image, so that the cutting devices can execute the cuts at the predetermined locations. At the same time, the stacking device may be activated such that during the sequential gathering of the signatures and/or individual sheets with different back lengths and/or different widths, the desired separating locations are created into which the supplements are inserted.

The opening element of a first embodiment may be provided with a guide element which is connected to a continuously circulating traction mechanism, wherein a slider is arranged in the guide element to be displaceable transverse to the conveying direction of the printed products. An insertion device of this type permits opening the multipage printed products at the specified page, provided in the format-preparing region with different back lengths. The feeding arrangement can be provided with a separating sword.

The opening device according to another embodiment is arranged at an upstream end of the separating sword and is embodied as a pivoting opening element, which can be used to deflect the projecting signatures and/or individual sheets of the multipage printed products, optionally to the right or to the left, transverse to the conveying direction. An insertion device of this type permits opening at the precisely specified page of the multipage printed products that were previously provided in the format-preparing region with signatures and/or individual sheets having different widths.

The insertion device may have a conveying channel with channel walls having a maximum height that is less than the width of the multipage printed products.

According to a different embodiment, several insertion devices can also be arranged sequentially in conveying direction, for example to allow different supplements to be inserted at different separating locations into the multipage printed products.

BRIEF DESCRIPTION OF THE DRAWINGS

These and other features and advantages of the invention will be further understood from the following detailed description with reference to the accompanying drawings.

DETAILED DESCRIPTION

Figure 1:
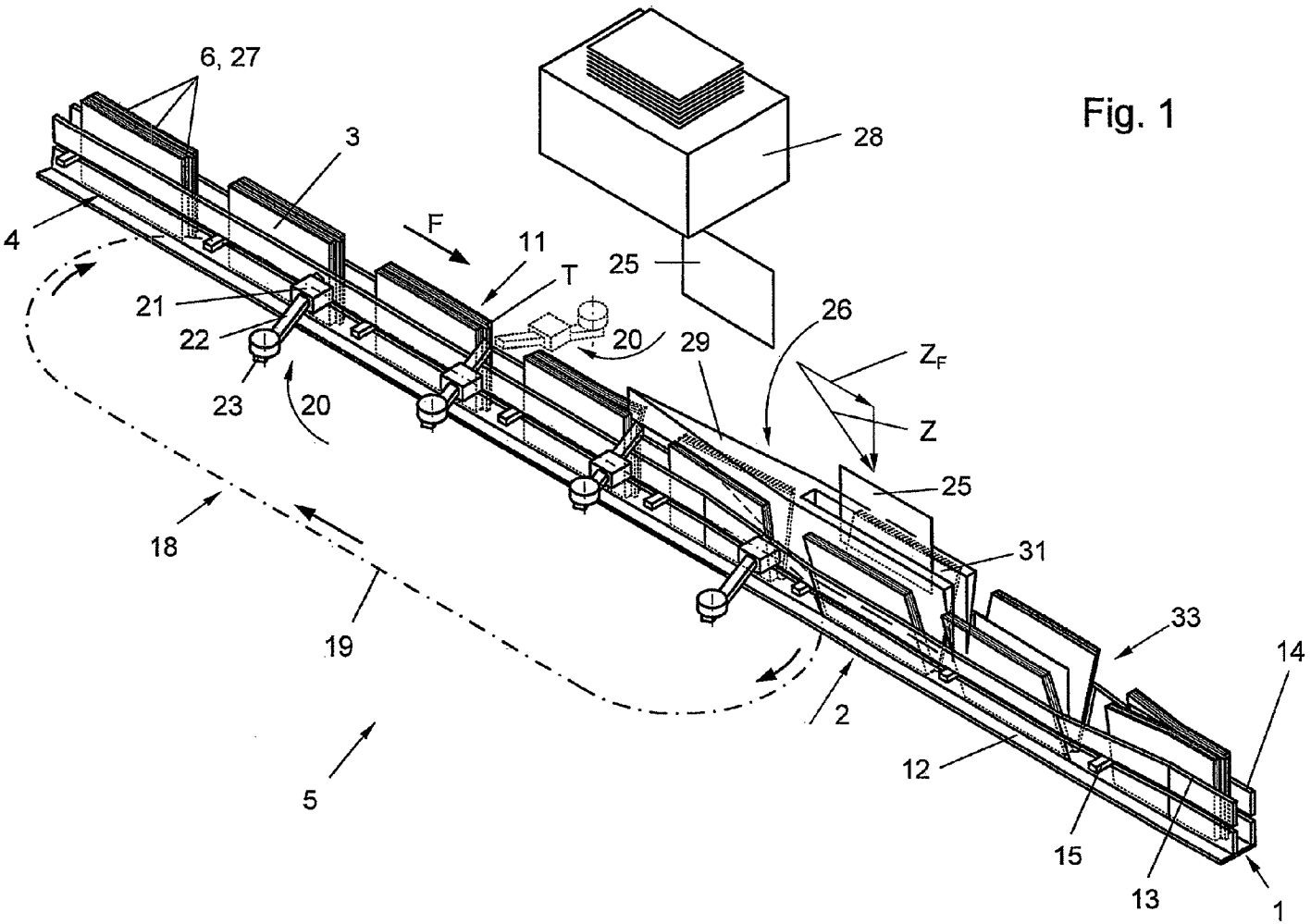
FIG. 1 is a three-dimensional view of a first exemplary embodiment of an insertion device according to the invention for inserting at least one supplement into multipage printed products.
Figure 2:
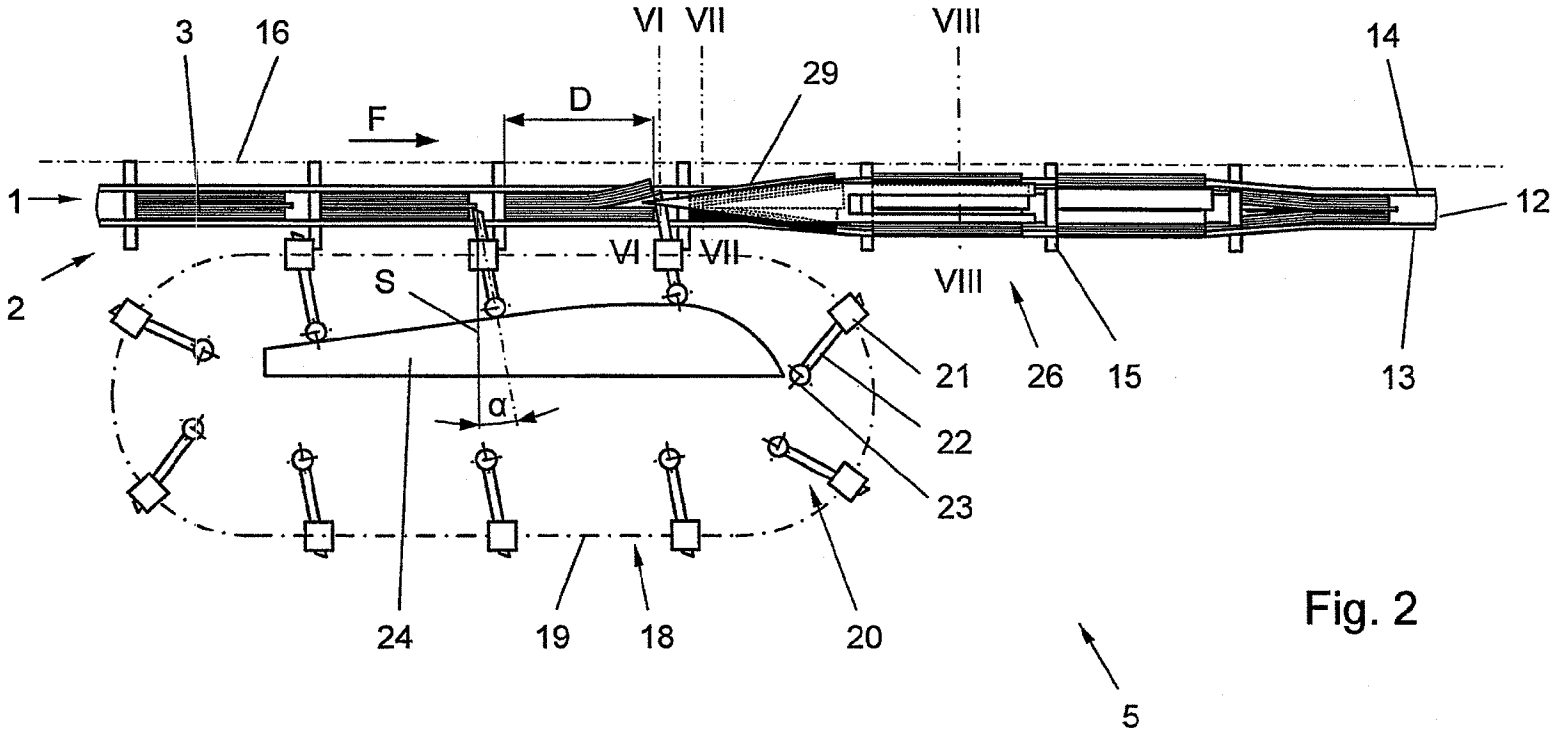
FIG. 2 is a plan view of the insertion device according to FIG. 1.

FIGS. 1 and 2 show a first embodiment of an insertion device 5, including a conveying mechanism 2, an opening device 18 and a feeding arrangement 26.

As shown in FIG. 2, the conveying mechanism 2 includes a circulating drive element 16, pushers 15, as well as a substantially perpendicular arranged U-shaped conveying channel 1. The conveying channel 1, as shown in FIG. 1, comprises a front channel wall 13, a rear channel wall 14, as well as a support 12.

As shown in FIG. 2, the opening device 18 comprises a control cam 24, a traction mechanism 19 with thereto attached uniformly spaced-apart opening elements 20, including guide elements 21, sliders 22 and rollers 23. An opening element 20 of this type comprises the guide element 21 which is connected to the traction mechanism 19 and is guided inside a non-depicted guide arrangement, wherein the slider 22 is positioned in the guide element 21 and is guided in the upstream section of the insertion device 5 so that it is essentially displaceable transverse to the conveying direction F for the printed products 3. The movement direction of the slider 22 forms an acute angle $\alpha$ with a perpendicular line S to the conveying direction F. The sliders 22 are driven with the aid of rollers 23, arranged on the sliders 22, which follow the control curve 24 that extends along the conveying mechanism 2, wherein springs between the sliders 22 and the guide elements 21, which are not shown herein, press the rollers 23 against the control curve 24.

The pushers 15 and thus also the multipage printed products 3, as well as of the opening elements 20, may move at the same speed in the conveying direction F. At least in the upstream section of the insertion device 5, the channel walls 13, 14 are only high enough so that the multipage printed products 3 can project with the open side 11 (FIG. 1) from the conveying channel 1. The feeding arrangement 26 for the supplements 25 (FIG. 1), which includes a separating sword 29 and a feed opening 31, is provided downstream of an intervention position for the slider 22, in the region of the conveying mechanism 2, as shown in FIGS. 1 and 2.

A supplement feeder 28 is arranged above the insertion device 5 and is used to supply the supplements 25 to the feeding arrangement. In FIG. 1, the supplement feeder 28 is shown at a farther distance, so as to provide a better view. However, this feeder is may be arranged directly above the feed opening 31 in the separating sword 29.

Figure 4A:
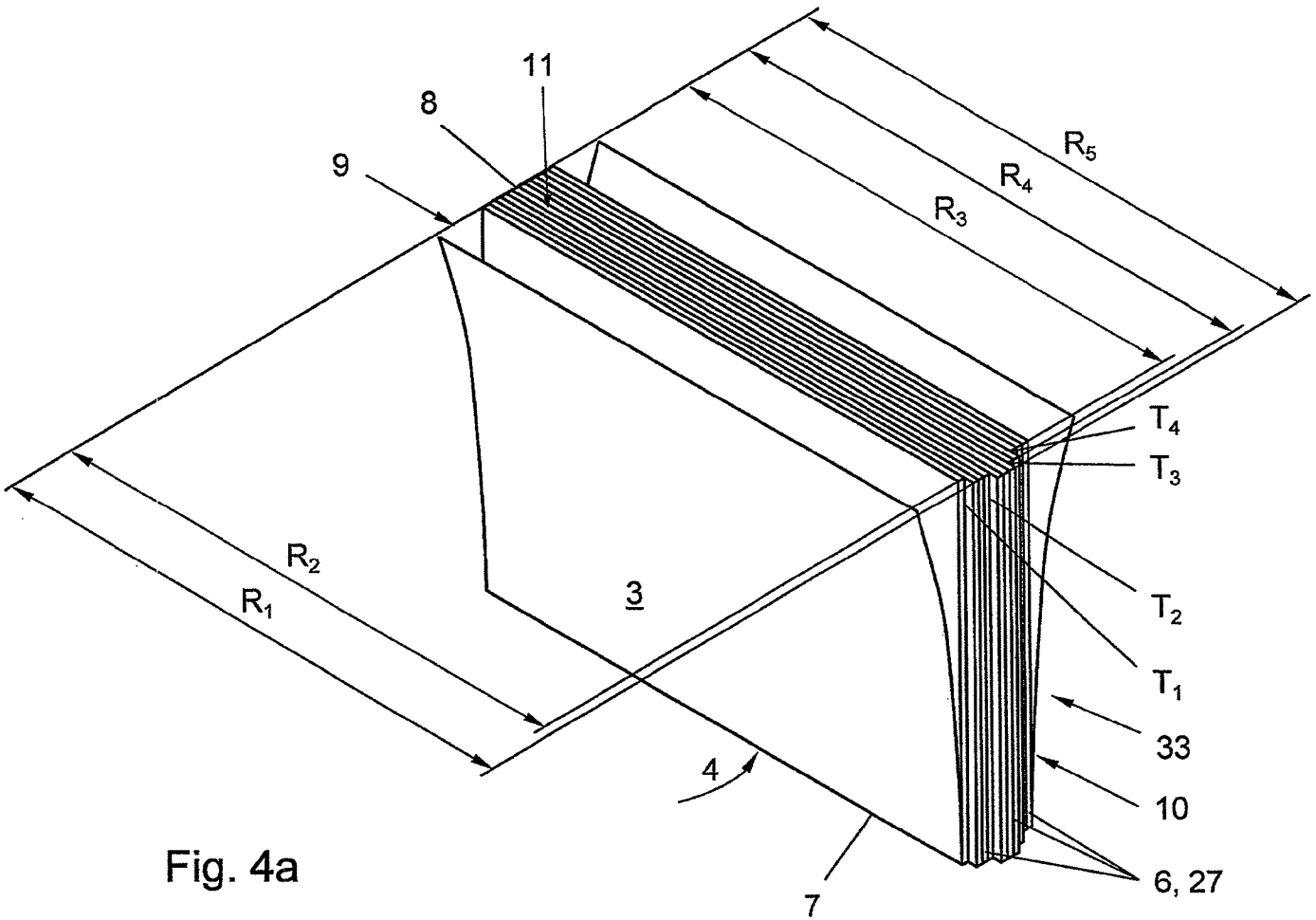
FIG. 4*a* is a diagram illustrating a first embodiment of a multipage printed product.
Figure 4B:
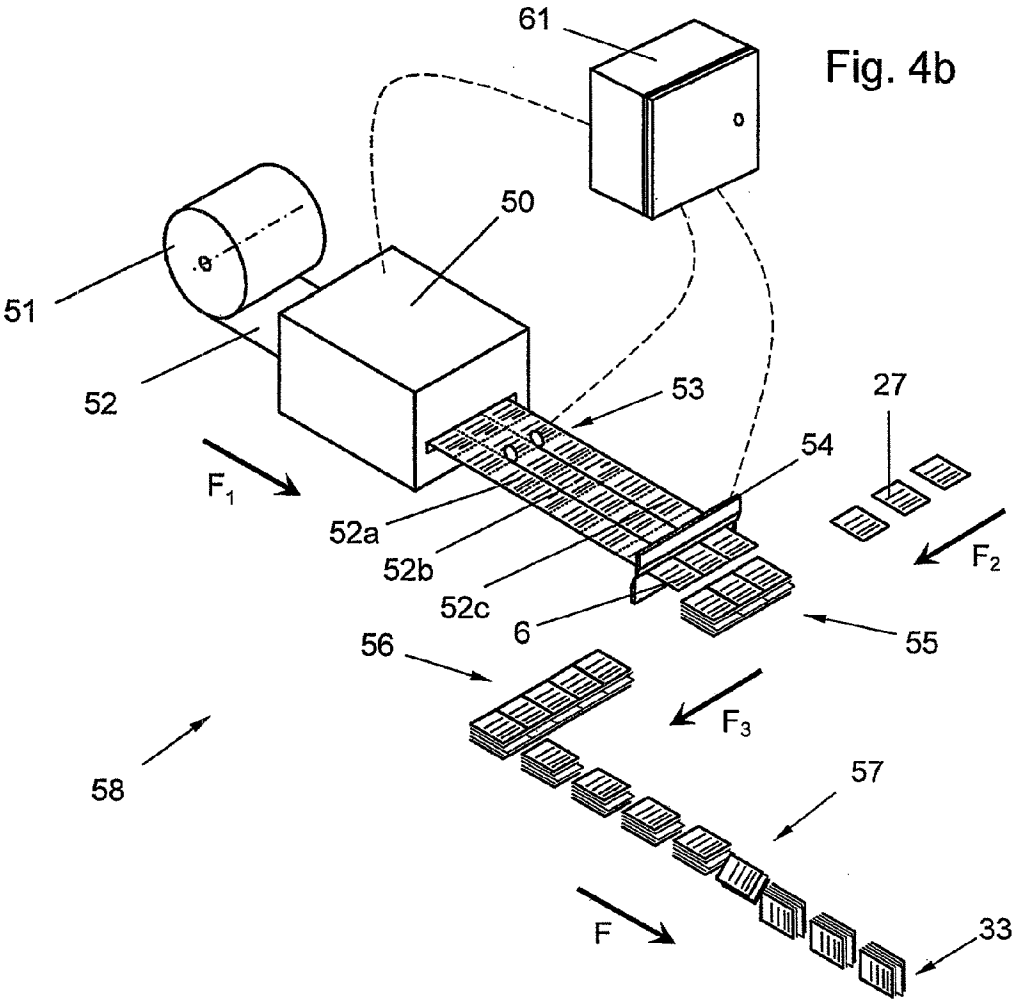
FIG. 4*b* is a schematic of a first embodiment of a device for producing a multipage printed product.
Figure 5A:
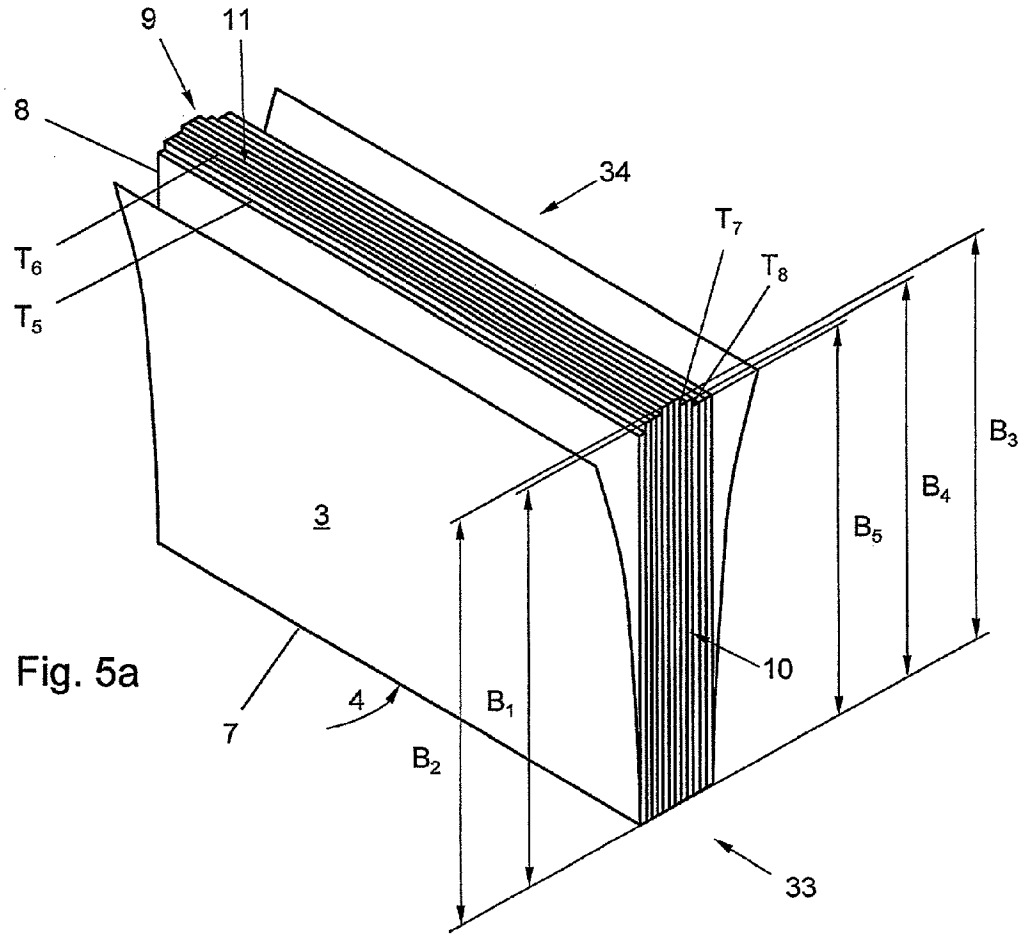
FIG. 5*a* is a diagram illustrating a second embodiment of a multipage printed product.
Figure 5B:
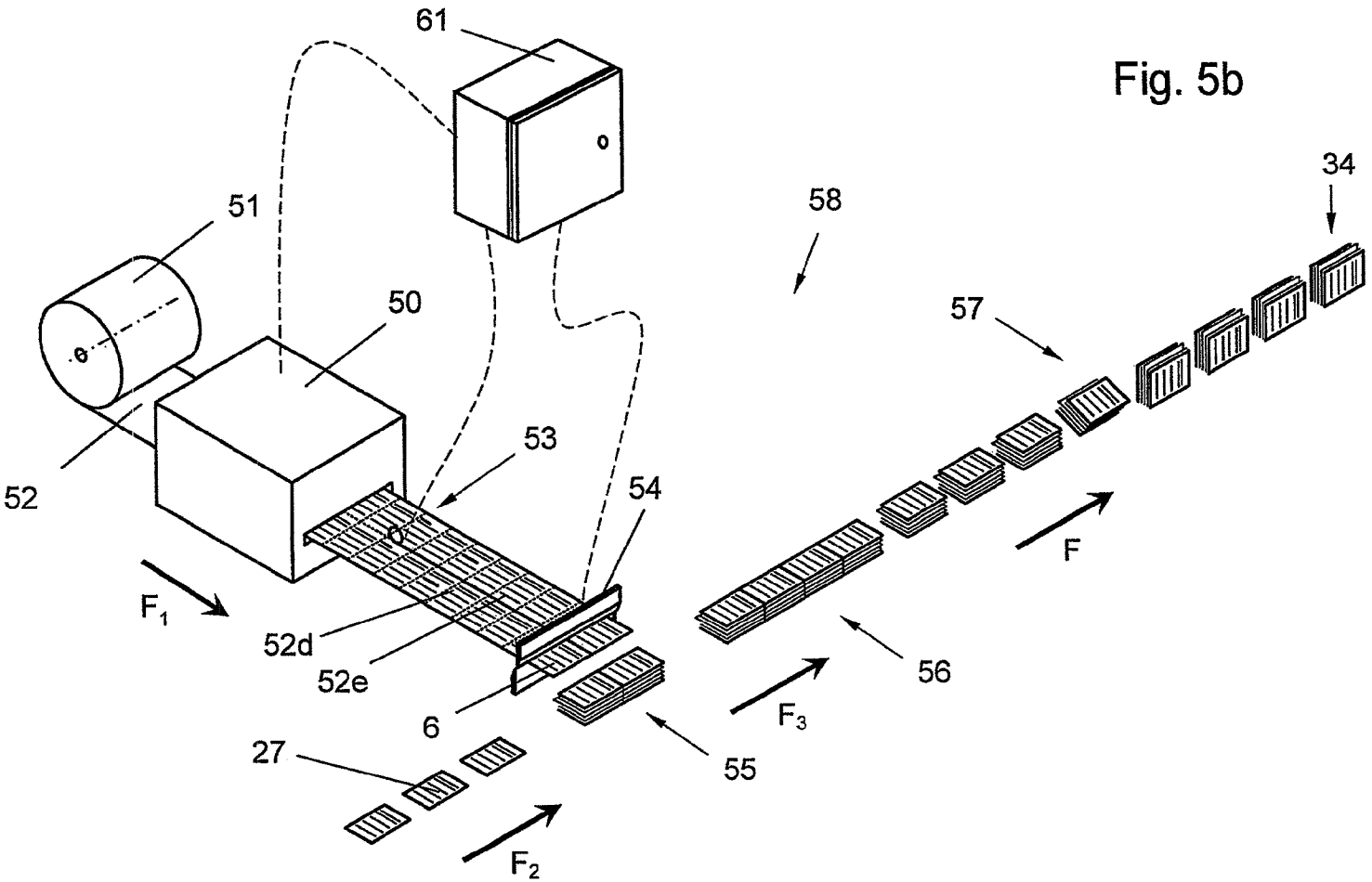
FIG. 5*b* is a schematic of a second embodiment of a device for producing a multipage printed product.

FIGS. 4*b* and 5*b* show a format-preparing region 58, located upstream of the insertion device 5. This region comprises a printing press 50 and/or an additional printing press (not shown herein), cutting devices 53, 54, a stacking device 55, and a buffer section 56.

Figure 3:
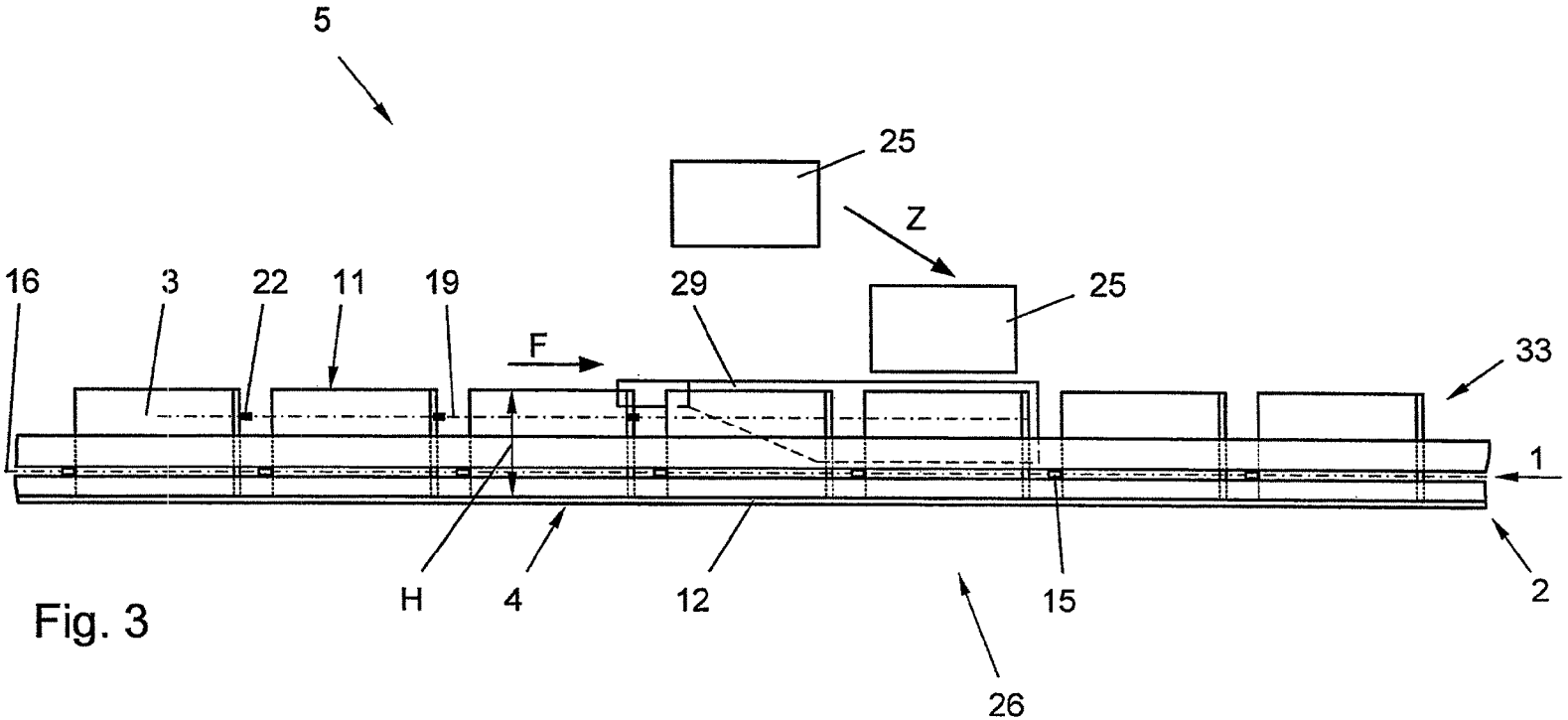
FIG. 3 is a side view of the conveying mechanism and the feeding arrangement of the insertion device according to FIG. 1.

With the aid of the conveying mechanism 2, shown in FIGS. 1 to 3, the multipage printed products 3, which are taken over from the format-preparing region 58 and are provided with at least one supplement 25, are transported with the backs 4 pointing downward in the conveying direction F through the insertion device 5 for inserting the supplements 25 into the printed products.

The multipage printed products 3, e.g. books, booklets, catalogs or magazines, shown in FIGS. 4*b* and 5*b*, are understood to refer to unbound book blocks composed of gathered signatures 27 and/or individual sheets 6, or they refer to crudely bound books blocks which are bound with adhesive or wire stitching or thread stitching and are also composed of signatures 27 or individual sheets 6. The signatures 27 are folded or non-folded individual sheets 6 or an arrangement of several individual sheets 6, fitted one into the other and connected by a fold along one side edge or connected in a different manner. The individual sheets 6 arrive from a printing press 50, for example, where the individual sheets for a subsequent printed product are printed sequentially onto a material web such as paper that is unrolled from a paper roll 51. Following this, the printed web 52 is cut as seen in conveying direction $F_1$ with the cutting devices 53, 54 into individual sheets 6. The signatures 27 can come from a printing press (not shown herein) which prints the individual signatures 27 for a subsequently produced printed product in a similar manner. Following the printing operation, these signatures 27 can be folded and/or cut with the aid of cutting devices and can be supplied in the conveying direction $F_2$ to the stacking device 55.

All individual sheets 6 and signatures 27 of a multipage printed product 3 are generally aligned relative to two reference edges 7, 8, for example the back 4 and a head 9 of the printed product 3, as shown in FIGS. 4*a* and 5*a*. At a bottom 10, arranged opposite the head 9, respectively the front edge 33 and the open side 11 that is arranged opposite the back 4 or the top edge 34 of the printed product 3, the individual sheets 6 and the signature 27 are embodied such that they project differently far from the product, corresponding to their different back lengths $R_1 \ldots R_5$ and/or the different widths $B_1 \ldots B_5$.

The production of individual sheets 6 with different formats is illustrated with the aid of respectively an embodiment, meaning the production of individual sheets 6 having either different back lengths $R_1 \ldots R_5$ and/or different widths $B_1 \ldots B_5$. The production of these individual sheets 6 represents the preparatory method step for forming the separating locations $T_1 \ldots T_8$ in the printed product 3, meaning between adjacent individual sheets 6 having different formats.

Instead of being composed solely of individual sheets 6, the printed products/book blocks 3 can be composed of signatures 27 and/or individual sheets 6. The signatures 27 can furthermore have different back lengths $R_1 \ldots R_5$ and/or different widths $B_1 \ldots B_5$ and can additionally also be provided with at least one fold.

As shown in FIGS. 4*b* and 5*b*, the printing press 50 prints onto a paper web 52 that is supplied by a paper roll 51, either in longitudinal direction or in lateral direction, relative to the back 4 of the future multipage printed product 3. Corresponding to the print image, the cutting device 53 in the form of a longitudinal cutter subsequently cuts the paper web 52 into web sections 52*a*, 52*b*, 52*c* of approximately the same width as the width of the future printed product 3, as shown in FIG. 4*b*, or into web sections 52*d*, 52*e* of the same length R which correspond to the back length of the future printed product 3, as shown in FIG. 5*b*. The cutting device in the form of a cross cutter subsequently takes over the cutting of the paper web sections 52*a*, 52*b*, 52*d*, 52*e*, previously cut in the conveying direction $F_1$, into individual sheets 6 with different formats, meaning either into sheets with different back lengths $R_1 \ldots R_5$ or different widths $B_1 \ldots B_5$. A control unit 61 is used to activate the cutting devices 54 for making the cuts at the desired locations, wherein this control unit can activate the printing press 50 via control connections, so as to create markings on the print image which cause the cutting device 54 to make cuts at the predetermined locations. It is also conceivable that the control unit 61 activates the cutting device 54 to make cuts at the precise locations on the basis of measuring results provided by a connected measuring device. In addition, a longitudinal and/or lateral folding apparatus can also be arranged downstream of the cutting device 54, so as to form signatures 27 with several pages.

Inside the stacking device 55, which is known per se and is not shown in further detail herein, the individual sheets 6 supplied in the conveying direction $F_1$ and/or the signatures 27 supplied in the conveying direction $F_2$ are gathered into multipage printed products 3. The multipage printed products 3, supplied in the conveying direction $F_3$ to a buffer section 56, are subsequently supplied in the conveying direction F to an upright-positioning element 57, also not shown in further detail herein, and are prepared for subsequent transport in the conveying channel 1.

The stacking device 55 is provided with signatures 27 which are produced ahead of time. For this, the signatures 27 are made available in a stack and can be supplied with a non-depicted separating device in conveying direction $F_2$ to the stacking device 55. The back lengths $R_1 \ldots R_5$ and/or the widths $B_1 \ldots B_5$ of the prefabricated signatures 27 can also have back lengths which differ from those of the remaining signatures 27. The control unit 61 is used to coordinate the sequence for supplying the signatures 27 to the correct location in the printed product 3.

The stacking device 55 then takes over the gathering of the signatures 27 and/or the individual sheets 6 with different back lengths $R_1 \ldots R_5$ and/or different widths $B_1 \ldots B_5$, in a sequence which is required to form the desired separating locations $T_1 \ldots T_8$ for inserting the supplements 25. The necessary information and processing algorithms can be stored in the control unit 61. The control unit 61 can be linked to the control units of other devices arranged upstream or downstream.

Figure 8:
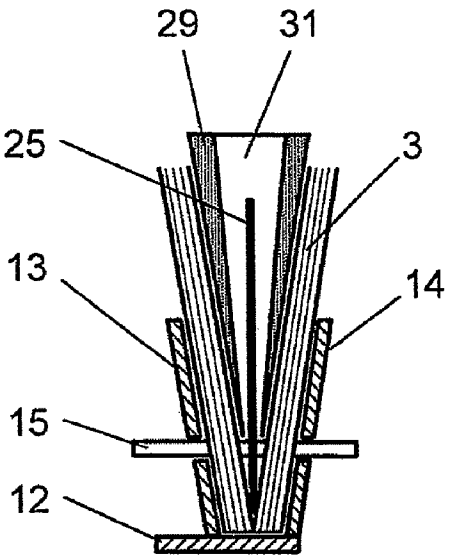
FIG. 8 is a section along the line VIII-VIII through a device according to FIG. 2, seen in a direction counter to the conveying direction.
Figure 7:
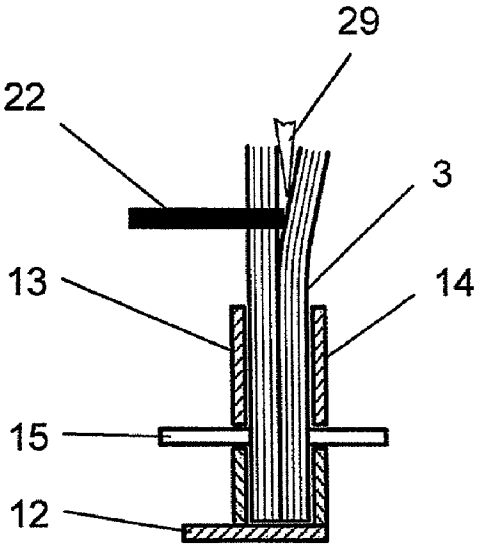
FIG. 7 is a section along the line VII-VII through a device according to FIG. 2, seen in a direction counter to the conveying direction.
Figure 6:
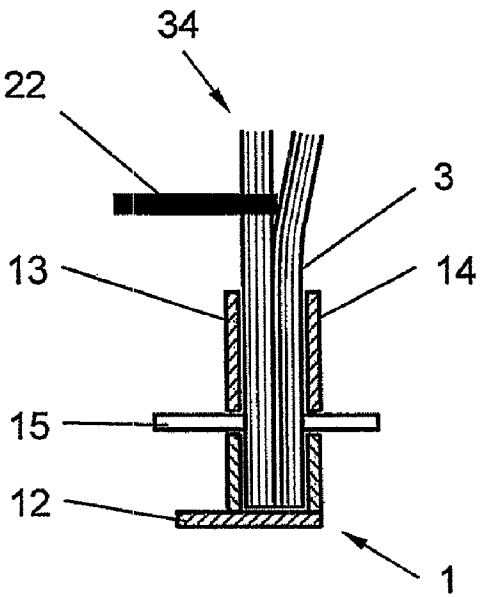
FIG. 6 is a section along the line VI-VI through a device according to FIG. 2, seen in a direction counter to the conveying direction.

In order to adapt the width of the conveying channel 1 to the width of the multipage printed products 3, at least one channel wall 13, 14 is embodied adjustable transverse to the conveying direction F, as shown in FIGS. 6 to 8.

The circulating drive mechanism 16, for example a chain, which is shown in FIG. 2 and is provided with regularly spaced-apart pushers 15, conveys the multipage printed products 3 by pushing them along the conveying mechanism 2, wherein the pushers 15 extend through the channel walls 13, 14. As a result of this conveying by pushing, the signatures 27 and/or the individual sheets 6 are aligned on the pushers 15 and rest against the pushers. According to an embodiment, the opening device 18 which is provided with opening elements 20 on the circulating traction mechanism 19, is arranged along an upstream section of the insertion device 5, on the side and parallel to the conveying mechanism 2. For reasons of a better overview, only one opening device 18 is shown in FIG. 1. Of course, an opening device 18 of this type can be arranged on each side of the insertion device 5, meaning the printed products 3 can be opened from both sides with the opening elements 20.

During the forward movement transverse to the conveying direction F, the sliders 22 impact with the signatures 27, or the individual sheets 6, or parts thereof which project from the multipage printed products 3, thereby causing a preliminary separation of the multipage printed products 3. The multipage printed products 3 can thus be opened at the precise page with the aid of the opening device 18, meaning at the location where at least one individual sheet 6 or one signature 27 projects relative to the other signatures 27 or individual sheets 6. Thus, if during the production the back lengths R1 . . . R4 of the individual sheets 6 are selected such that two individual sheets 6 with different lengths are fitted against each other precisely at the location where the supplement 25 is to be inserted, the multipage printed products 3 can be opened at the predetermined page locations. An intended separating location $T_1, T_2, T_3, T_4$ in the printed products 3 can be selected by adjusting a distance D between the slider 22 of the opening element 20 that acts upon a printed product 3 and the pusher 15 which transports this printed product 3. For example, if the printed product 3 is to be opened at the separating location $T_1$, then the distance D must be adjusted to a value between the back length $R_1$ and the back length $R_2$.

The printed product 3 shown in FIG. 4*a* on the whole comprises four possible separating locations $T_1 \ldots T_4$ which are defined by different back lengths $R_1 \ldots R_5$ of the signatures 27 or the individual sheets 6. An opening device that is positioned in a mirror-image arrangement opposite the opening device 18 and is illustrated in dotted lines in FIG. 1 only in the form of an opening element 20, is provided for the opening at the separating locations $T_3$, $T_4$. Alternatively, the printed products 3 can also be opened with the opening device 18 at the separating locations $T_3$, $T_4$. For this, the sliders 22 are provided with a nose, also not shown herein, for gripping behind the projecting signatures 27 or the individual sheets 6. The previously separated, multipage printed products 3 are guided across the separating sword 29 and are opened further during the continued transport in the conveying direction F while the slider 22 of the opening element 20 is pulled back once more. The separating sword 29 which is arranged above the slider 22 opens up the printed product 3 far enough so that one or several supplements 25 can be inserted into the opened printed product 3 via the downstream-arranged feed opening 31 in the separating sword 29 (FIG. 2).

With a constant speed of the conveying mechanism 2 and the opening device 18 in the conveying direction F, the multipage printed products 3 as well as the supplements 25 are not subjected either to accelerations or delays in the conveying direction F, thus allowing high production speeds. During the feeding of the supplements 25 to the printed product 3, a speed component $Z_F$ of the speed Z for supplying the supplements 25 in the conveying direction F may correspond approximately to the conveying speed for the multipage printed products 3. With lower production speeds, however, it is also conceivable that the speed of the conveying mechanism 2 and the speed of the opening device 18 are changed cyclically and synchronously, for example so as to place the supplements 25 into a stopped printed product 3.

According to one embodiment of the invention, several opening devices 18 and feeding arrangements 26 can be arranged sequentially one behind the other in the conveying direction F, so that the supplements 25 can be inserted into a printed product 3 at different locations either manually or with the aid of supplement feeders 28. In addition, changing the distance D accordingly between the sliders 22 of the opening elements 20 and the associated pushers 15 of the drive mechanism 16, multipage printed products 3 can furthermore be opened optionally at different locations, meaning the supplements 25 can be inserted at different locations into the printed products 3. The height of the opening device 18, relative to the support 12 of the conveying channel 1, can be adjusted for adapting it to the different widths of multipage printed products 3.

One advantageous use of the invention results from the processing of the individual sheets 6, which are printed and cut immediately prior to the binding operation on a printing press 50 that is embodied as a digital printing press. Digital printing presses continuously and sequentially print page after page of a product, which later forms the printed product 3, onto the paper web 52 which is unwound from a paper roll 51 and is then cut into the individual sheets 6, wherein the printed image as well as the back length $R_1 \ldots R_5$ (FIG. 4*b*) or the width $B_1 \ldots B_5$ (FIG. 5*b*) can change continuously from individual sheet 6 to individual sheet 6. If the gathered printed product 3 comprises signatures 27 in addition to individual sheets 6, or is composed only of signatures 27, the separating locations $T_1 \ldots T_4$ can be selected to be located before and/or after and/or in the center of the signatures 27. For example, if individual sheets 6 with different widths $B_1 \ldots B_5$ are produced, it is possible to create purposely selected separating locations $T_5 \ldots T_8$ between adjacent individual sheets 6. According to a second exemplary embodiment shown in FIGS. 9 and 10, a printed product 3 which is produced in this way and is shown in FIG. 5*a* can be opened in a simple manner directly with the opening device 18' in the form of an opening element 30 at the four separating locations $T_5 \ldots T_8$. In that case, the separating locations $T_5 \ldots T_8$ can be selected with the aid of the height difference H between the support 12 of the conveying channel 1 and the opening element 30. For example, if the printed product 3 is to be opened at the separating location $T_5$, the height value H must be adjusted to a value between the width $B_1$ and the width $B_2$.

Figure 9:
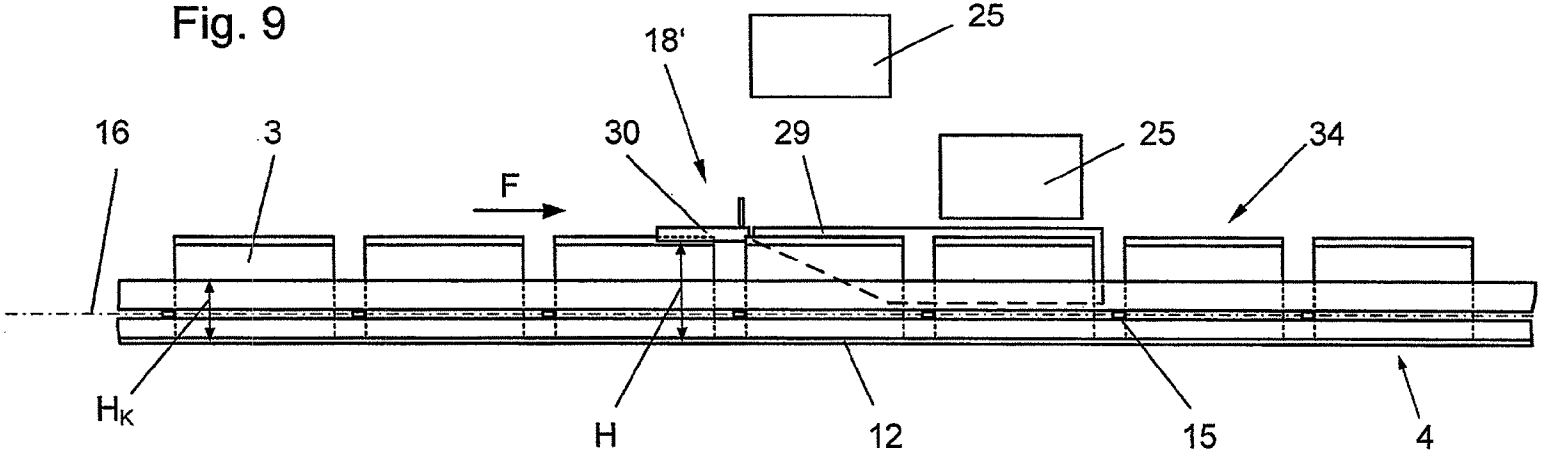
FIG. 9 is a side view of another embodiment of the device according to the invention.
Figure 10:
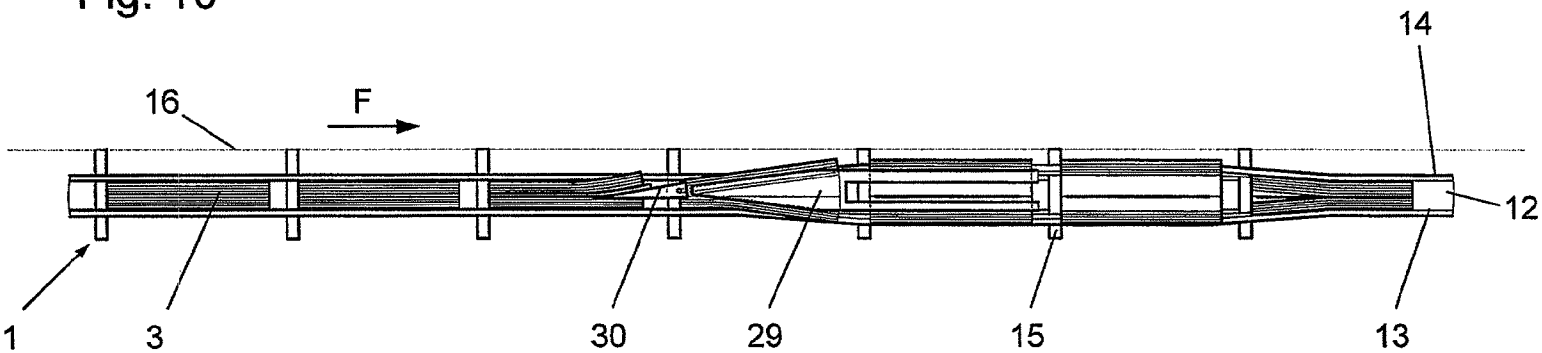
FIG. 10 is a plan view of the device according to FIG. 9.

According to an embodiment, the opening device 18' is embodied at the upstream end of the separating sword 29, in the form of a pivoting opening element 30 as shown in FIGS. 9 and 10. As a result, projecting portions of the individual sheets and/or the signatures 27 can thus be easily deflected optionally toward the back or the front and can be opened. The conveying channel 1 of the conveying mechanism 2 in this case comprises channel walls 13, 14 for which the maximum Height $H_K$ is less than the width of the multipage printed products 3.

The supplements 25 can subsequently be supplied in the manner as described in the above. In all Figures, the printed product 3 is shown with the back 4 pointing downward during the processing. This vertical orientation has the advantage that the supplements 25 can be placed into the opened printed product 3 with the aid of the pull of gravity. However, the present invention is not restricted to the vertical orientation of the multipage printed products 3, but also comprises the orientation at any optional angle to the perpendicular line for the conveyed multipage printed products 3.

However, a position deviating from the vertical position requires a correspondingly adapted and more involved conveying mechanism 2 and feeding arrangements 26.

It will be understood that the above description of the present invention is susceptible to various modifications, changes and adaptations, and the same are intended to be comprehended within the meaning and range of equivalents of the appended claims.

What is claimed is:

1. A method for inserting a supplement into a multipage printed product, having a back and composed of signatures and/or individual sheets, and being transported with the back oriented parallel to a conveying direction, comprising:

supplying the multipage printed product with a signature or an individual sheet projecting from the multipage printed product to define a predetermined separating location between the projecting signature or individual sheet and an adjacent signature or sheet;

opening the multipage printed product at the predetermined separating location by inserting a displaceable opening element from one side against the projecting portion;

expanding the opening at the separating location in the multipage printed product; and inserting the supplement into the expanded separating location.

2. The method according to claim 1, further comprising:

a format-preparing step including:

producing two signatures or two individual sheets or a signature and an individual sheet, having respective formats, wherein one signature or one individual sheet has a format that differs from the format of the other signature or individual sheet; and gathering the signatures and/or individual sheets to form the multipage printed product by arranging directly adjacent each other the two signatures with different formats, or the two individual sheets with the different format, or the one signature and one individual sheet with different formats, to form the predetermined separating location at which one signature or individual sheet projects from the multipage printed product.

3. The method according to claim 2, wherein the format-preparing step takes place at a separate space and/or at a different time, or immediately prior to supplying the multipage printed products.

4. The method according to claim 2, wherein the format preparing step includes producing one signature or one individual sheet during the format-preparing step with a back length and/or a width which differs from that of the other signatures and/or individual sheets.

5. The method according to claim 1, wherein the transporting includes transporting the multipage printed product with a conveying mechanism that includes a pusher to push the multipage printed product along in the conveying direction, and wherein the multipage printed product is aligned on the conveying mechanism according to two reference edges and with the back pointing downward.

6. The method according to claim 2, wherein the multipage printed product comprises a signature or an individual sheet with a back length that differs from the back lengths of other signatures or individual sheets, and the opening step includes opening the multipage printed product along one front edge of the multipage printed product.

7. The method according to claim 6, wherein the inserting includes inserting the opening element into the separating location of the multipage printed product at an acute angle relative to a line perpendicular to the conveying direction.

8. The method according to claim 6, wherein the inserting includes causing the opening element to follow a control curve to undergo a movement sequence in the conveying direction.

9. The method according to claim 5, including driving the opening element with a first speed and the pusher with a second speed, wherein the first and second speeds in the conveying direction are at least approximately the same.

10. The method according to claim 9, wherein the first speed of the opening element and the second speed of the pusher are changed cyclically and synchronously.

11. The method according to claim 9, including arranging opening elements on both sides of the conveying mechanism in the conveying direction and the opening includes opening the multipage printed product from both sides with the opening elements.

12. The method according to claim 2, wherein the multipage printed product includes a signature or an individual sheet with a width that differs from the width of other signatures or individual sheets, and the opening includes opening the multipage printed product along a top edge of the multipage printed product by inserting an opening element from the top into the separating location.

13. The method according to claim 12, including adjusting a distance between the opening element and the back of the multipage printed product to correspond to the width of the projecting signature or sheet.

14. The method according to claim 1, wherein the expanding includes expanding the separating location with a separating sword and the inserting includes inserting the supplement into the multipage printed product through a feed opening in the separating sword.

15. The method according to claim 1, wherein the inserting includes supplying the supplement to the multipage printed product with a speed component of a feeding speed which at least approximately corresponds to a conveying speed of the multipage printed product in the conveying direction.

16. The method according to claim 1, wherein the supplying step includes supplying the multipage printed product with a plurality of separating locations defined by respective projecting sheets and/or signatures, and further including opening and expanding the multipage printed product at the respective separating locations and inserting a respective supplement into the opened and expanded separating locations.

17. The method according to claim 1, wherein the inserting includes inserting the supplement into the opened, multipage printed product at an angle between 0 degrees and 180 degrees with respect to a plane extending through the back of the multipage printed product.

18. The method according to claim 17, wherein the angle is approximately perpendicular to the plane extending through the back of the multipage printed product.

19. The method according to 17, further comprising compressing the multipage printed product during the transporting on a side in a region of the back of the multipage printed product.

20. An insertion device to insert a supplement into a multipage printed product composed of signatures and/or individual sheets with a back oriented parallel to a conveying direction of the insertion device, comprising:

a conveying mechanism to convey the multipage printed product in the conveying direction;

an opening device to open the multipage printed product at a predetermined separating location where a signature or an individual sheet has a projection portion that projects from the multipage printed product, wherein the opening device comprises an opening element that is displaceable against one side of the projecting portion to open the multipage printed product at the predetermined separating location; and a feeding arrangement to insert the supplement at the separating location.

21. The insertion device according to claim 20, further comprising a format preparing region with a stacking device to form the predetermined separating location in the multipage printed product.

22. The insertion device according to claim 20, further comprising a stacking device, at least one of a printing press and a cutting device, and a control unit to activate the stacking device and at least one of the printing press and the cutting device.

23. The insertion device according to claim 20, further comprising a circulating traction mechanism, wherein the opening element comprises a guide element connected to the circulating traction mechanism, and a slider arranged in the guide element to be displaced transverse to the conveying direction for the printed product.

24. The insertion device according to claim 20, wherein the feeding arrangement comprises a separating sword.

25. The insertion device according to claim 24, wherein the opening device is arranged at an upstream end of the separating sword and comprises a pivoting opening element to optionally deflect a projecting signature or individual sheet of the multipage printed product in a direction transverse to the conveying direction.

26. The insertion device according claim 20, further comprising a conveying channel having channel walls with a maximum height less than a width of the multipage printed product.

27. An insertion arrangement comprising a plurality of insertion devices according to claim 20 arranged sequentially, one behind the other, in the conveying direction.

* * * * *

UNITED STATES PATENT AND TRADEMARK OFFICE

CERTIFICATE OF CORRECTION

PATENT NO. : 8,371,571 B2
APPLICATION NO. : 13/195322
DATED : February 12, 2013
INVENTOR(S) : Günther Silberbauer et al.

It is certified that error appears in the above-identified patent and that said Letters Patent is hereby corrected as shown below:

Title Page, Item

"(73) Assignee: Mueller Martini Holdings AG" should read

--(73) Assignee: Mueller Martini Holding AG--

Signed and Sealed this
Sixteenth Day of April, 2013

Teresa Stanek Rea

Teresa Stanek Rea
*Acting Director of the United States Patent and Trademark Office*